US011052419B2

(12) United States Patent
Trovi

(10) Patent No.: US 11,052,419 B2
(45) Date of Patent: Jul. 6, 2021

(54) ROLLER DEVICE FOR APPLYING AN ADHESIVE ONTO A SURFACE

(71) Applicant: QUARRATA FORNITURE S.r.l., Quarrata (IT)

(72) Inventor: Roberto Trovi, Quarrata (IT)

(73) Assignee: QUARRATA FORNITURE S.r.l., Quarrata (IT)

( * ) Notice: Subject to any disclaimer, the term of this patent is extended or adjusted under 35 U.S.C. 154(b) by 387 days.

(21) Appl. No.: 16/082,106

(22) PCT Filed: Mar. 2, 2017

(86) PCT No.: PCT/IB2017/051212
§ 371 (c)(1),
(2) Date: Sep. 4, 2018

(87) PCT Pub. No.: WO2017/149483
PCT Pub. Date: Sep. 8, 2017

(65) Prior Publication Data

US 2020/0282421 A1 Sep. 10, 2020

(30) Foreign Application Priority Data

Mar. 4, 2016 (IT) ..... 102016000022791

(51) Int. Cl.
*B05C 1/08* (2006.01)
*B05C 1/16* (2006.01)

(52) U.S. Cl.
CPC ..... *B05C 1/0865* (2013.01); *B05C 1/0808* (2013.01); *B05C 1/165* (2013.01); *B05C 1/0826* (2013.01)

(58) Field of Classification Search
CPC ..... B05C 1/08; B05C 1/0865; B05C 1/0808; B05C 1/165; B05C 1/0826; B05C 1/16;
(Continued)

(56) References Cited

U.S. PATENT DOCUMENTS 1,587,638 A * 6/1926 Feybusch ..... B05C 1/0834 118/245
4,999,079 A * 3/1991 Ash ..... B05C 1/0821 118/114

(Continued)

FOREIGN PATENT DOCUMENTS

EP 2540501 A1 2/2013
GB 06301 4/1916

OTHER PUBLICATIONS

International Search Report for PCT/IB2017/051212, dated May 17, 2017.

(Continued)

*Primary Examiner* — Laura Edwards
(74) *Attorney, Agent, or Firm* — Shuttleworth & Ingersoll, PLC; Timothy Klima

(57) ABSTRACT

Described is a device (10) for applying an adhesive (C). The device (10) comprises at least one rotary gluing member (21, 31) designed to transfer to a mass of adhesive (C) towards a surface to be glued (S) and a plurality of rotating distributor members (51*a-g*) susceptible to being interposed, in operation, between the gluing members (21, 31) and the surface to be glued (S). The plurality of distributor members (51*a-g*) comprises a first portion of distributor members (51*b*, 51*d*, 51*f*) susceptible to make contact with the gluing member (21, 31) and a second portion of distributor members (51*a*, 51*c*, 51*e*, 51*g*) susceptible to remaining spaced from the gluing member (21, 31).

20 Claims, 2 Drawing Sheets

(58) Field of Classification Search
CPC .... Y10S 118/14; Y10S 118/15; B29C 65/526; B32B 37/1292; B44C 7/04; Y10T 156/1798; B65C 2009/0075
USPC ..... 118/216, 219, 221, 244
See application file for complete search history.

(56) References Cited

U.S. PATENT DOCUMENTS

| | | | | |
|---|---|---|---|---|
| 5,480,681 | A | 1/1996 | VerMehren | |
| 2001/0027153 | A1* | 10/2001 | Koehn | B05C 1/0808 492/30 |

OTHER PUBLICATIONS

Italian Search Report dated Oct. 26, 2016 from counterpart Italian Patent Application No. UA20161351.

* cited by examiner

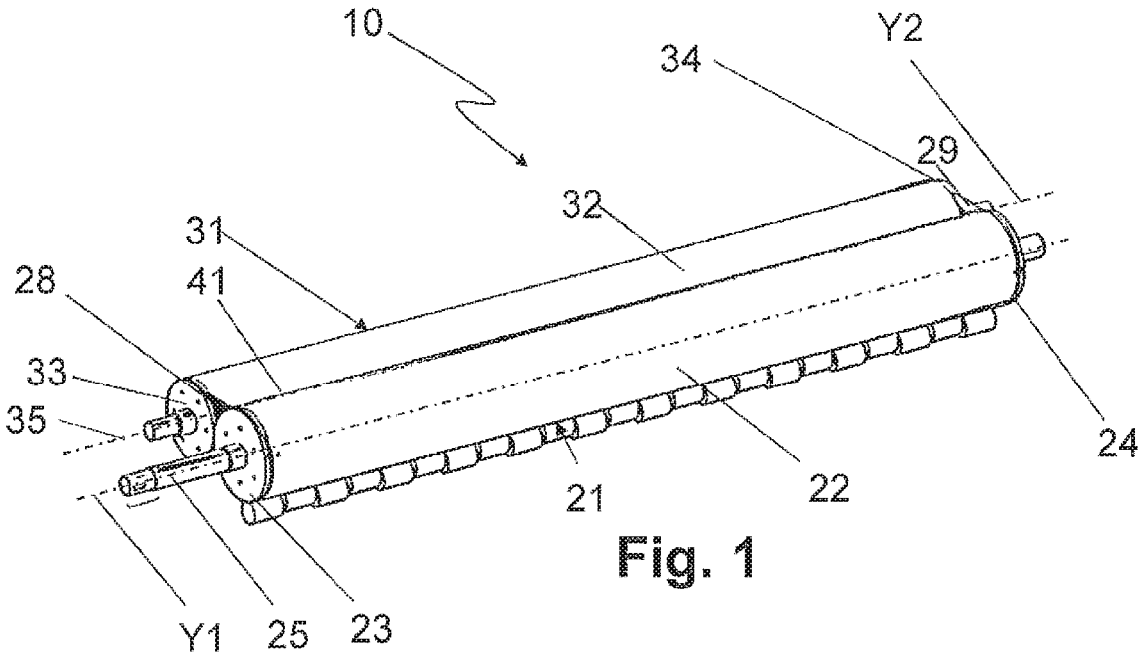
Fig. 1
Fig. 2
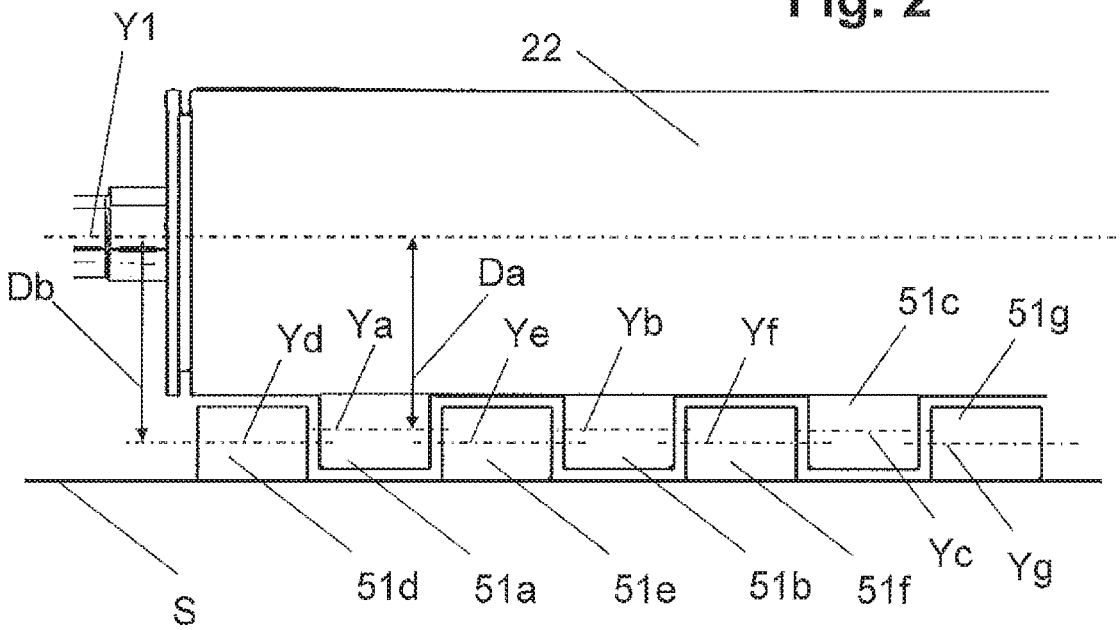

ROLLER DEVICE FOR APPLYING AN ADHESIVE ONTO A SURFACE

CROSS REFERENCE TO RELATED APPLICATIONS

This application is a national stage filing under section 371 of International Application No. PCT/IB2017/051212, filed on Mar. 2, 2017, published in English on Sep. 8, 2017 as WO 2017/149483 A1 which claims priority to Italian Patent Application No. 102016000022791, filed on Mar. 4, 2016, the entire disclosure of these applications being hereby incorporated herein by reference.

TECHNICAL FIELD

The invention relates to a device for applying an adhesive on a surface. The device according to the invention is particularly, although not exclusively, usable for applying an adhesive on a sheet for mattresses.

BACKGROUND ART

Mattresses without springs are currently produced by gluing on top of each other several sheets made of suitable material, for example expanded polyurethane, and each having the shape in plan of the mattress. Spring mattresses, on the other hand, comprise a container made from several sheets designed to make the respective walls of the container, and designed to house the springs of the mattress. The container, before being closed by gluing the sheet forming the upper base surface on the sheets which form the side walls, is designed to receive the system of springs of the mattress.

The glue, or adhesive, may be a water-based solvent.

Usually, without considering the application by brush, solvent adhesives can be applied by spraying and water-based adhesives can be applied both by spraying and spreading with rollers.

Spreading by rollers, which can be either manual or automatic, is performed by two smooth counter-rotating cylindrical rollers which are translated on the application surface of the sheet, thereby rolling on that surface.

The pair of rollers is completed by panels, which are located on opposite sides of the pair of rollers. These panels face the base surfaces of the rollers on one side and on the other side both the side surfaces of the rollers, and are positioned transversally to the respective axes of rotation, in such a way as to close laterally the space interposed between the two rollers. The adhesive is supplied inside the "tank" which forms centrally between the respective side surfaces of the rollers, which are coaxial to the two axes of rotation, and the side panels.

The distance, which can usually be adjusted, between the two side-by-side surfaces of the rollers determines the dosage of the adhesive during the application step; a larger space allows a greater passage of adhesive, whilst a smaller distance, on the other hand, limits the quantity applied.

In all cases, the device described above allows the application of a uniform layer of adhesive, for the full length of the rollers, on a rectangular area, having one dimension equal to the length of the rollers and the other dimension coinciding with the distance travelled by the rollers during the application step. It is therefore not possible to obtain, on the rectangular area, a differentiated distribution of the adhesive, according to the specific drawings depending on the surface to be glued, or to reduce and optimise the quantity of adhesive used.

DISCLOSURE OF THE INVENTION

The aim of this invention is to provide a device for applying adhesive on a surface, particularly on sheets for mattresses, which allows the precision in depositing adhesive to be increased also in relation to the pattern to be obtained on the surface to be glued.

Another aim of this invention is to provide a device for applying adhesive on a surface, particularly on sheets for mattresses, which allows the quantity of adhesive used to be educed and optimised.

The aims indicated are substantially achieved by a device for applying adhesive comprising the technical features described in one or more of the appended claims.

BRIEF DESCRIPTION OF THE DRAWINGS

Further features and advantages of this invention are more apparent in the detailed description below, with reference to some preferred, non-limiting, embodiments of a device for applying adhesive as illustrated in the accompanying drawings, in which:

FIG. 1 is an axonometric view of a device for applying adhesive according to a possible embodiment of the invention;

FIG. 2 is a partial side view of the detail II of FIG. 1;

DETAILED DESCRIPTION OF PREFERRED EMBODIMENTS OF THE INVENTION

Figure 3:
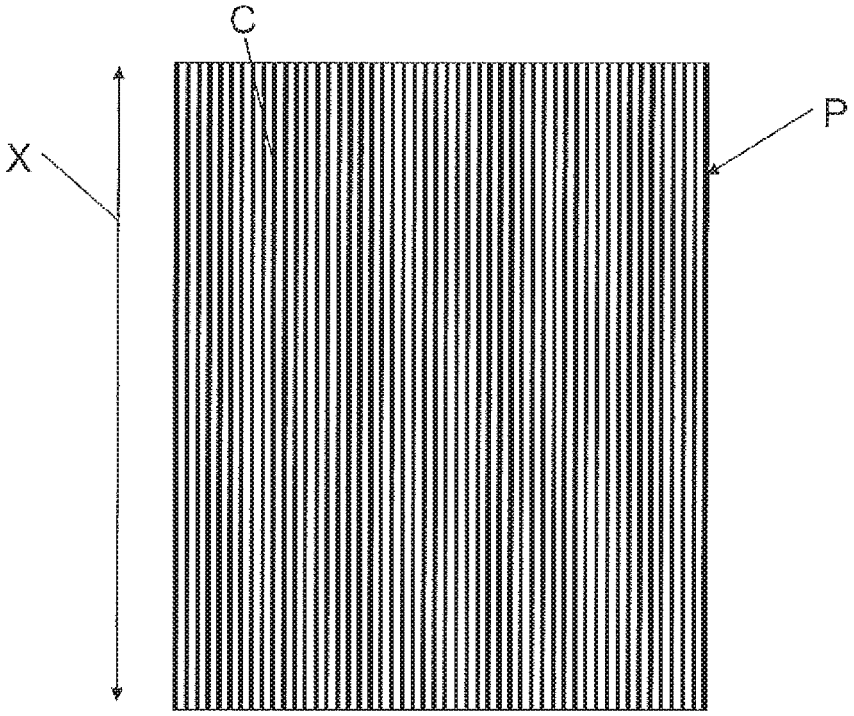
FIG. 3 is a geometric diagram of a layer of adhesive applicable by means of the device according to the invention.

With reference to the accompanying drawings, a device 10 is described below for applying a fluid adhesive C on a surface S, in particular a sheet for mattresses, according to this invention.

The adhesives particularly used for the gluing of sheets for mattresses are: water-based adhesive, that is to say, resins in aqueous dispersion.

The device 10 comprises a first gluing member 21 and a second gluing member 31. The gluing members 21, 31 are cylindrical, axially extended along respective longitudinal axes Y1, Y2, and are spaced from each other in such a way as to form a transit opening 41 between them. The longitudinal axes Y1, Y2 are parallel to each other.

Each of the gluing members 21, 31 includes a respective cylindrical outer side surface 22, 32, a first circular base 23, 33 and a second circular base 24, 34, axially opposite to the first circular base 23, 33.

The outer side surfaces 22, 32 of the two gluing members 21, 31 are smooth and may have equal or different diameters.

Each outer surface 22, 32 is coupled to a respective shaft 25, 35, passing through the respective first circular base 23, 33 and the respective second circular base 24, 34. The coupling with the respective shaft 25, 35 allows each outer surface 22, 32 to be rotatable about the respective longitudinal axis Y1, Y2. The outer surfaces 22, 32 are counter-rotating relative to each other, in such a way that each of them rotates towards the transit opening 41.

The device 10 also comprises a first panel 28 and a second panel 29, for connecting together the gluing members 21, 31, at their axial ends, in a direction transversal to the longitudinal axes Y1, Y2. The first panel 28 is extended between the first circular base 23 of the first gluing member 21 and the first circular base 33 of the second gluing member 31. The second panel 29 is extended between the second circular base 23 of the first gluing member 21 and the second circular base 33 of the second gluing member 31. The connection between the gluing members 21, 31 and the panels 28, 29 is made in such a way that the distance between the gluing members 21, 31 and therefore the transversal dimension of the transit opening 41 are adjustable.

The panels 28, 29 and the cylindrical outer side surfaces 22, 32 of the gluing members 21, 31 define a 'tank' for receiving and distributing the adhesive C. The tank is open at the top, in such a way as to receive a mass of adhesive C, by gravity or spray, on the outer side surfaces 22, 32. For example, according to possible variant embodiments, the adhesive C may be distributed on the outer side surfaces 22, 32, by means of a dispensing nozzle (not shown in the accompanying drawings). The tank is also open at the bottom, at the transit opening 41, to allow the transfer of the adhesive C from the gluing members 21, 31 to the surface to be glued, through the transit opening 41. The rotation of the outer side surfaces 22, 32 facilitates the flow of the adhesive C to the surface to be glued.

The application of the adhesive C present on the outer side surfaces 22, 32 occurs by rotating the outer side surfaces 22, 32 about the respective longitudinal axes Y1, Y2 and simultaneously translating, along a direction at right angles to the longitudinal axes Y1, Y2, the device 10 on the surface to be glued S. The distribution of the glue on the surface to be glued S occurs by means of the rotation of the outer side surfaces 22, 32, gravity and, if necessary, pressing the device 10 on the surface to be glued S.

To allow the distribution of a layer of adhesive C having a desired pattern P, the device 10 comprises at least one distributor member susceptible of being interposed, in operation, between one of the gluing members 21, 31 and the surface to be glued S.

In the example shown in the accompanying drawings, the device 10 comprises a plurality of rotating distributor members 51*a-g* located close to the outer side surface 22 of the first gluing member 21, in such a way as to be interposed during the gluing operations, between the first gluing member 21 and the surface to be glued S. This determines that the direction of translation of the device 10, during application of the adhesive C, is oriented from the first gluing member 21 towards the second gluing member 31. In this way, both the first gluing member 21 that the distributor members 51*a-g* are, during the application of the adhesive C, located downstream of the transit opening 41 relative to the flow of the mass of adhesive C. During the application of the adhesive C, due to the effect of the overall translation of the gluing device 10, the rotation of the outer side surfaces 22, 32 and gravity, the adhesive C flows towards the first gluing member 21 and the distributor members 51*a-g*. As shown in more detail below, the adhesive C is distributed on the surface to be glued S, according to a desired pattern P, by means of the distributor members 51*a-g*. According to possible gluing methods, during the distribution of the adhesive C to the device 10 and, in particular, to the distributor members 51*a-g* a pressure force is applied against the surface to be glued S.

According to another variant embodiment (not illustrated) the rotary distributor members 51*a-g* are located close to the outer side surface 32 of the second gluing member 31, in such a way as to be interposed during the gluing operations, between the second gluing member 31 and the surface to be glued S. This determines that the direction of translation of the device 10, during application of the adhesive C, is oriented from the second gluing member 31 towards the first gluing member 21. The operation, taking into account the opposite direction of translation, is similar to that described above with reference to the example embodiment of the accompanying drawings.

The plurality of distributor members 51*a-g* comprises a first portion of the distributor members (three distributor members 51*a*, 51*b*, 51*c*, in the example embodiment of the accompanying drawings) susceptible to making contact with the outer side surface 22 of the first gluing member 21 and a second portion of distributor members (four distributor members 51*d*, 51*e*, 51*f*, 51*g* in the example embodiment of the accompanying drawings) susceptible to remaining spaced from the outer side surface 22 of the first gluing member 21.

The contact between the distributor members 51*a-g* and the surface to be glued S is therefore characterised by an irregular, or in any case not rectilinear, trend. This determines, since the translation of the device 10 forces the passage of the adhesive C between distributor members 51*a-g* and the surface to be glued S, a distribution pattern P of the adhesive C dependent on geometry and the distribution of the distributor members 51*a-g*, according to the specific embodiments of this invention.

According to another example embodiment (not illustrated) the device 10 comprises a single distributor member, susceptible to being interposed, in operation, between one of the gluing members 21, 31 and the surface to be glued S. In this example embodiment, the single distributor member comprises at least a first surface performing the same function as the first portion of distributor members 51*a*, 51*b*, 51*c*, that is to say, making contact with the outer side surface 22 of the first gluing member 21 and a second surface performing the same function as the second portion of distributor members 51*d*, 51*e*, 51*f*, 51*g* that is susceptible to remaining spaced from the outer side surface 22 of the first gluing member 21.

With reference to the example embodiment of the accompanying drawings, the distributor members 51*a-g* consist of respective cylindrical rollers, rotatable about respective axes of rotation Ya-g, parallel to each other and parallel to the axis of rotation Y1 of the first gluing member 21. The distributor members 51*a-g* are positioned relative to the gluing members 21, 31 in such a way that the plane through the respective axes of rotation Ya-g and through the axis of rotation Y1 of the first gluing member 21 is at a right angle to the plane passing through the axes of rotation Y1, Y2 of the gluing members 21, 31.

According to other variant embodiments (not illustrated) the distributor members 51*a-g* have shape different to the cylindrical shape, for example they consist of cams.

In the example embodiment shown in the accompanying drawings, the axes Ya, Yb, Yc of the first portion of distributor members 51*a*, 51*b*, 51*c* are located a first distance Da from the axis of rotation Y1 of the first gluing member 21 and the axes Yd, Ye, Yf, Yg of the second portion of distributor members 51*d*, 51*e*, 51*f*, 51*g* are located at a second distance Db from the axis of rotation Y1, which is greater than the first distance Da. The first distance Da is chosen in such a way that the first portion of the distributor members 51*a*, 51*b*, 51*c* is in contact with the first gluing member 21.

The distributor members 51*a-g* are distributed along the first gluing member 21 according to an alternating configuration, that is, in such a way that each of the distributor members 51*a*, 51*b*, 51*c* of the first portion are interposed between two respective distributor members 51*d*, 51*e*, 51*f*, 51*g* of the second portion of rotary distributor members.

According to other variant embodiments (not illustrated), the distributor members 51*a-g* have an distribution different from the alternating one described above. For example, sequences of distributor members 51*a-g* are possible located side by side at the same distance Da or Db from the axis of rotation Y1 of the first gluing member 21.

According to other possible variant embodiments, the distributor members 51*a-g* are mounted on translatory members (not illustrated) in such a way that the respective distances Da, Db of the axes of rotation Ya-g from the axis of rotation Y1 of the first gluing member 21 are variable. More specifically, it is possible to vary the distances in such a way that the second portion of distributor members 51*d*, 51*e*, 51*f*, 51*g* are located in contact with the first gluing member 21 and the first portion of distributor members 51°, 51*b*, 51*c* are spaced from the first gluing member 21.

According to other variant embodiments (not illustrated) the axes of rotation Ya-g of the distributor members 51*a-g* are not parallel to each other.

According to other variant embodiments (not illustrated) the axes of rotation Ya-g of the distributor members 51*a-g* are not coplanar with the axis of rotation Y1 of the first gluing member 21.

In all the variant embodiments of this invention, at least a part of the distributor members 51*a-g* is in contact with the first gluing member 21 in such a way as to receive from it a mass of adhesive C to be transferred on the surface to be glued S. The remaining part of the distributor members 51*a-g*, which is not in contact with the first gluing member 21, is susceptible of making contact with, in operation, the surface to be glued S. At the distributor members 51*a-g* which are not in contact with the first gluing member 21 (for example, the second portion of distributor members 51*d*, 51*e*, 51*f*, 51*g*) the surface to be glued S does not receive the adhesive C.

FIG. 3 shows a first pattern P with 'lines' of the layer of adhesive C distributed on a surface to be glued S using a gluing device 10 having a plurality of distributor members distributed along the first gluing member 21 according to a an alternating configuration similar to that of FIGS. 1 and 2. In this alternating configuration, the odd distributor members are in contact with the first gluing ember 21 and therefore transfer the adhesive C on the surface to be glued S, whilst the even distributor members are not in contact with the first gluing member 21 and do not therefore transfer the adhesive C on the surface to be glued S. This configuration is maintained for the entire gluing stroke X of the gluing device 10.

Figure 4:
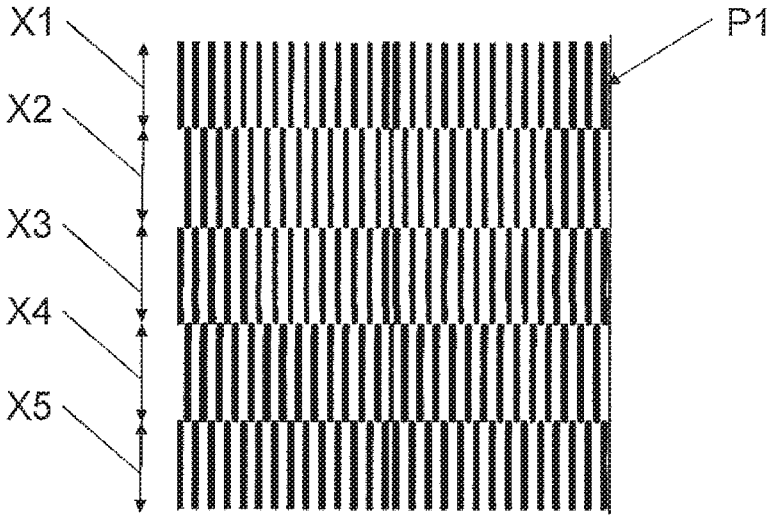
FIG. 4 is a second geometric diagram of a layer of adhesive applicable by means of the device according to the invention.

FIG. 4 shows a second pattern P1 with 'squares' of the layer of adhesive C distributed on a surface to be glued S using a gluing device 10 having a plurality of distributor members distributed along the first gluing member 21 according to a an alternating configuration similar to that of FIGS. 1 and 2. This pattern is obtained by varying the distances of the axes of rotation Ya-g from the axis of rotation Y1 of the first gluing member 21, during the gluing stroke. In a first section X1, a third section X3 and a fifth section X5 of the gluing stroke, the odd distributor members are in contact with the first gluing member 21 and therefore transfer the adhesive C to the surface to be glued S, whilst the even distributor members are not in contact with the first gluing member 21 and do not therefore transfer the adhesive C to the surface to be glued S. On the other hand, in a second section X2 and in a fourth stretch X4 of the gluing stroke, the even distributor members are in contact with the first gluing member 21 and therefore transfer the adhesive C to the surface to be glued S, whilst the odd distributor members are not in contact with the first gluing member 21 and do not therefore transfer the adhesive C to the surface to be glued S.

Generally speaking, according to the different possible variant embodiments of this invention, it is possible to obtain any pattern P, by suitably selecting the form and the distribution of the plurality of distributor members 51*a-g*.

More specifically, the pattern can be suitably selected in such a way as to guarantee an optimum and economic distribution of the adhesive C, optimising the quantity so as to prevent waste.

This invention lends itself in particular also for modifying existing gluing devices equipped with two smooth gluing members 21, 31. In these gluing devices, the addition of one or more distributor members, such as those described above, allows a gluing devices 10 to be obtained according to this invention.

The invention claimed is:

1. A device for applying an adhesive onto a surface to be glued, the device comprising:

a rotating first gluing member and a rotating second gluing member configured to transfer a mass of the adhesive to the surface to be glued, a plurality of rotating distributor members configured to being interposed, in operation, between the surface to be glued and at least one chosen from the first gluing member and the second gluing member, the distributor members comprising:

a first portion of distributor members configured for coming into contact with the at least one chosen from the first gluing member and the second gluing member, and a second portion of distributor members configured for remaining spaced from the at least one chosen from the first gluing member and the second gluing member, the first and second gluing members being rotatable about respective axes of rotation, the plurality of distributor members being rotatable about respective axes of rotation, in such a way that, in operation, due to the rotation of the first and second gluing members and of the distributor members, the mass of the adhesive is transferred from the first and second gluing members to the surface to be glued through the first portion of distributor members;

the axes of the first portion of distributor members being placed at a first distance from the axis of rotation of the first rotating gluing member and the axes of the second portion of distributor members being placed at a second distance from the axis of rotation of the first gluing member, the second distance being greater than the first distance.

2. The device according to claim 1, wherein the first gluing member is placed, relative to a flow of the mass of the adhesive, downstream of the second gluing member, the distributor members are placed close to an outer side surface of the first gluing member, the first portion of distributor members being placed in contact with the first gluing member.

3. The device according to claim 1, wherein the distributor members are distributed along the first gluing member so that each of the distributor members of the first portion is interposed between two distributor members of the second portion.

4. The device according to claim 1, wherein at least one chosen from the first distance and the second distance is variable.

5. The device according to claim 1, wherein the distributor members are cylindrical.

6. The device according to claim 1, wherein at least one of the axes of rotation of the distributor members is parallel to the axis of rotation of the first gluing member.

7. The device according to claim 1, wherein the axes of rotation of the distributor members are coplanar relative to the axis of rotation of the first gluing member.

8. The device according to claim 2, wherein the distributor members are distributed along the first gluing member so that each of the distributor members of the first portion is interposed between two distributor members of the second portion.

9. The device according to claim 8, wherein at least one chosen from the first distance and the second distance is variable.

10. The device according to claim 9, wherein the distributor members are cylindrical.

11. The device according to claim 10, wherein at least one of the axes of rotation of the distributor members is parallel to the axis of rotation of the first gluing member.

12. The device according to claim 11, wherein the axes of rotation of the distributor members are coplanar relative to the axis of rotation of the first gluing member.

13. The device according to claim 2, wherein at least one chosen from the first distance and the second distance is variable.

14. The device according to claim 13, wherein the distributor members are cylindrical.

15. The device according to claim 14, wherein at least one of the axes of rotation of the distributor members is parallel to the axis of rotation of the first gluing member.

16. The device according to claim 15, wherein the axes of rotation of the distributor members are coplanar relative to the axis of rotation of the first gluing member.

17. The device according to claim 2, wherein the distributor members are cylindrical.

18. The device according to claim 2, wherein at least one of the axes of rotation of the distributor members is parallel to the axis of rotation of the first gluing member.

19. The device according to claim 2, wherein the axes of rotation of the distributor members are coplanar relative to the axis of rotation of the first gluing member.

20. The device according to claim 3, wherein the axes of rotation of the distributor members are coplanar relative to the axis of rotation of the first gluing member.

* * * * *